US010249401B2

(12) United States Patent
Goto

(10) Patent No.: US 10,249,401 B2
(45) Date of Patent: Apr. 2, 2019

(54) ALUMINUM ALLOY WIRE, ELECTRIC WIRE, CABLE AND WIRE HARNESS

(71) Applicant: YAZAKI CORPORATION, Tokyo (JP)

(72) Inventor: Jundai Goto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 406 days.

(21) Appl. No.: 14/755,530

(22) Filed: Jun. 30, 2015

(65) Prior Publication Data

US 2015/0325325 A1 Nov. 12, 2015

Related U.S. Application Data

(63) Continuation of application No. PCT/JP2014/051046, filed on Jan. 21, 2014.

(30) Foreign Application Priority Data

Jan. 21, 2013 (JP) ..... 2013-008721

(51) Int. Cl.
*H01B 1/00* (2006.01)
*C22C 21/08* (2006.01)
(Continued)

(52) U.S. Cl.
CPC ..... *H01B 1/023* (2013.01); *C22C 21/02* (2013.01); *C22C 21/08* (2013.01); *C22F 1/04* (2013.01);
(Continued)

(58) Field of Classification Search
CPC ..... H01B 1/023; C22C 21/08; C22F 1/05
See application file for complete search history.

(56) References Cited

U.S. PATENT DOCUMENTS

2010/0071933 A1 3/2010 Otsuka et al.
2013/0264115 A1* 10/2013 Kobayashi ..... H01B 1/023 174/72 A
2014/0166162 A1 6/2014 Hirayama et al.

FOREIGN PATENT DOCUMENTS

CN 101536112 A 9/2009
CN 103703155 A 4/2014
(Continued)

OTHER PUBLICATIONS

International Search Report and Written Opinion of the International Search Report for PCT/JP2014/051046 dated Apr. 1, 2014.
(Continued)

*Primary Examiner* — George Wyszomierski
*Assistant Examiner* — Janell C Morillo
(74) *Attorney, Agent, or Firm* — Kenealy Vaidya LLP

(57) ABSTRACT

As a small-diameter conductor for electric wires for automobiles, provided is an aluminum alloy wire satisfying all requests of sufficient strength, elongation and electroconductivity. The wire is an aluminum alloy wire including: magnesium; silicon; and aluminum and inevitable impurities as the balance, the content (M) by atomic percentage (at %) of the magnesium in the wire and the content (S) by atomic percentage (at %) of the silicon satisfying the following expressions (1) and (2), a metallic microstructure of a cross section of the wire having an average crystal grain size of 3 to 20 μm, a precipitation size of the metallic microstructure in the cross section being 100 nm or less, and the number density of the precipitations in the cross section being one or more per square micrometer.

[Formula 1]

$$0.2 \leq M \leq 1.19 \quad (1), \text{ and}$$

$$-0.81M+1.44 \leq S \leq -1.54M+2.31 \quad (2).$$

8 Claims, 2 Drawing Sheets

(51) Int. Cl.

| | |
|---|---|
| ***H01B 1/02*** | (2006.01) |
| ***H01B 7/00*** | (2006.01) |
| ***C22F 1/047*** | (2006.01) |
| ***C22F 1/043*** | (2006.01) |
| ***C22F 1/04*** | (2006.01) |
| ***C22C 21/02*** | (2006.01) |

(52) U.S. Cl.
CPC ..... *C22F 1/043* (2013.01); *C22F 1/047* (2013.01); *H01B 7/0045* (2013.01)

(56) References Cited

FOREIGN PATENT DOCUMENTS

| | | | | |
|---|---|---|---|---|
| JP | 62-63655 | A | | 3/1987 |
| JP | 2001-254160 | A | | 9/2001 |
| JP | 2001254160 | A | * | 9/2001 |
| JP | 2008-112620 | A | | 5/2008 |
| JP | 2010-43303 | A | | 2/2010 |
| JP | 4646998 | B2 | | 3/2011 |
| JP | 2012-229485 | A | | 11/2012 |
| JP | 2013-76168 | A | | 4/2013 |

OTHER PUBLICATIONS

Chinese Office Action for the related Chinese Patent Application No. 201480005509.3 dated May 6, 2016.

* cited by examiner

ALUMINUM ALLOY WIRE, ELECTRIC WIRE, CABLE AND WIRE HARNESS

TECHNICAL FIELD

The present invention relates to an aluminum alloy wire, an electric wire and a cable in each of which this aluminum alloy wire is used as a conductor, and a wire harness.

BACKGROUND ART

As an aluminum alloy wire for a conductor, Patent Literature 1 discloses an aluminum alloy wire that has a composition including 0.2% or more to 1.0% or less of Mg, 0.1% or more to 1.0% or less of Si and 0.1% or more to 0.5% or less of Cu, and including Al and impurities as the balance, in which the ratio by mass of Mg/Si satisfies the following: $0.8 \leq Mg/Si \leq 2.7$.

When this alloy wire is produced through a process of "casting (continuous casting or billet casting), rolling, solution treatment, aging treatment, wire drawing, and final thermal treatment", the alloy wire can be produced as an aluminum alloy wire having a tensile strength of 120 to 200 MPa, an elongation of 10% or more, an electroconductivity of 58% IACS or more, and a diameter of 0.2 to 1.5 mm.

In such techniques, requests of making aluminum electric wires smaller in diameter have been enhancing in the light of recent needs that automobiles should be made lighter. A standard of aluminum electric wires for automobiles is JASO D603. According to this standard, the minimum electric wire size is 0.75 sq (a sectional area of 0.75 $mm^2$), and performances of an element wire that constitutes a conductor are prescribed as follows: a tensile strength of 70 MPa or more, an elongation of 10% or more, and an electroconductivity of 58% IACS or more.

In the case of referring to the respective sizes of copper electric wires for automobiles that are prescribed in JASO D611, as conductor sizes thinner than the above-mentioned size 0.75 sq, the following specifications in the future are foreseen: 0.5 sq (a section area of 0.5 $mm^2$), 0.35 sq (a section area of 0.35 $mm^2$), 0.22 sq (a section area of 0.22 $mm^2$), and 0.13 sq (a section area of 0.13 $mm^2$).

In general, as the size of a conductor is made smaller, the load resistance of the resultant electric wire becomes lower. Thus, when such a thin conductor is supplied, it is necessary to make an element wire therefor high in strength. In the case of, for example, a conductor size of 0.5 sq or less, the following is necessary in order that an electric wire having this conductor size can gain a load resistance performance equivalent to that of an electric wire having a conductor size of 0.75 sq: an element wire for the electric wire has a tensile strength of 100 MPa or more. Furthermore, in the case of a conductor size of 0.35 sq, an element wire therefor needs to have a tensile strength of 150 MPa. Such an element wire is required not only to be increased strength in this way, but also to have, as a conductor for electric wires for automobiles, an appropriate elongation and electroconductivity.

It is stated that as the aluminum alloy wire suggested in Patent Literature 1, an aluminum alloy wire can be produced having a tensile strength of 120 to 200 MPa, an elongation of 10% or more, an electroconductivity of 58% IACS or more, and a diameter of 0.2 to 1.5 mm as described above. However, when this alloy wire is used as a conductor for an aluminum electric wire thinner than 0.75 sq, which is the above-mentioned size, it is concerned that the alloy wire is insufficient in element wire strength. As described hereinbefore, an aluminum alloy wire for a conductor has been required which satisfies all requests that the wire should have a high strength, a sufficient elongation, and a sufficient electroconductivity.

CITATION LIST

Patent Literature

Patent Literature 1: JP 4646998 B2

SUMMARY OF INVENTION

Technical Problem

An object of the present invention is to overcome the above-mentioned problems in the prior art, that is, to provide an aluminum alloy wire, for conductors for automobiles, that can satisfy, as an aluminum electric wire having a conductor sectional-area smaller than 0.75 sq, all requests of a sufficient strength, a sufficient elongation, and a sufficient electroconductivity.

Solution to Problem

When the problems have been solved, the inventors have encountered the following technical difficulties.

When aging treatment is applied to a microstructure of an aluminum alloy material in which a high processing strain is caused to remain by high deformation, coarse $Mg_2Si$ stable phases are easily precipitated on dislocation lines or crystal grain boundaries in the microstructure. It is therefore forecast that with an increase in the quantity of the strain, the aluminum alloy is lowered in age hardenability (strength increase quantity based on the aging) and also lowered in ductility.

In order to avoid such problems, the inventors have expected that it is appropriate to conduct a T6 treatment step (thermal treatment step according to the JIS standard, in which an alloy wire-workpiece is subjected to solution treatment in a final-wire-diameter state to remove processing strain therein, and subsequently subjected to aging treatment). However, the inventors have investigated to find out that this T6 treatment step makes the resultant crystal gains extremely coarse relatively to the wire diameter through the solution treatment (for example, a crystal grain size of 100 μm relative to a wire diameter of 320 μm), so that the original material turns to a material having a property high in strength but brittle.

Thus, the inventors have made various investigations about the quantity proportion of magnesium and silicon added to an aluminum alloy base, aging treatment conditions, processing strain at the time of the aging treatment, and others for forming fine precipitations as much as possible in crystal grains of the alloy even when a wire-workpiece of the alloy is subjected to aging treatment in the state that processing strain remains therein. Thus, the present invention has been achieved.

Accordingly, in order to solve the problems, according to one aspect of the present invention, an aluminum alloy wire of the present invention includes: (A) magnesium; silicon; and aluminum and inevitable impurities as the balance, the content (M) by atomic percentage (at %) of the magnesium in the wire and the content (S) by atomic percentage (at %) of the silicon satisfying the following expressions (1) and (2), (B) a metallic microstructure of a cross section of the wire having an average crystal grain size of 3 μm or more to 20 μm or less, (C) a precipitation size of the metallic microstructure in the cross section being 100 nm or less, and (D) the number density of the precipitations in the cross section being one or more per square micrometer.

[Mathematical Formula 1]

$$0.2 \leq M \leq 1.19 \quad (1), \text{ and}$$

$$-0.81M+1.44 \leq S \leq -1.54M+2.31 \quad (2)$$

According to a first preferred aspect of the present invention, the aluminum alloy wire of the present invention may be the aluminum alloy wire according to the one aspect of the present invention, obtained by subjecting a raw material to solution treatment, subjecting the treated material to wire drawing into a sectional-area reduction of 99% or more until the material has a final wire diameter, and subsequently subjecting the resultant wire to aging treatment at a temperature of 200° C. or more to 250° C. or less for a period of 0.5 hour or more to 1 hour or less.

According to a second preferred aspect of the present invention, the aluminum alloy wire of the present invention may be the aluminum alloy wire according to the one aspect or the first preferred aspect of the present invention, having a tensile strength of 150 MPa or more, a tensile elongation of 10% or more, and an electroconductivity of 50% IACS or more.

According to a third preferred aspect of the present invention, the electric wire of the present invention includes, as a conductor, the aluminum alloy wire according to any one of the one aspect to the second preferred aspect of the present invention.

According to a fourth preferred aspect of the present invention, the cable of the present invention includes, as a conductor, the aluminum alloy wire according to any one of the one aspect to the second preferred aspect of the present invention.

According to a fifth preferred aspect of the present invention, the wire harness of the present invention for an automobile includes the electric wire according to the third preferred aspect of the present invention.

Advantageous Effects of Invention

According to the aluminum alloy wire of the present invention, it is possible that when the alloy wire is used as an aluminum conductor for electric wires for automobiles, the alloy wire can realize an electric wire satisfying, as an aluminum electric wire having a conductor sectional-area smaller than 0.75 sq, all requests of a sufficient strength, a sufficient elongation, and a sufficient electroconductivity.

DESCRIPTION OF EMBODIMENTS

Figure 1:
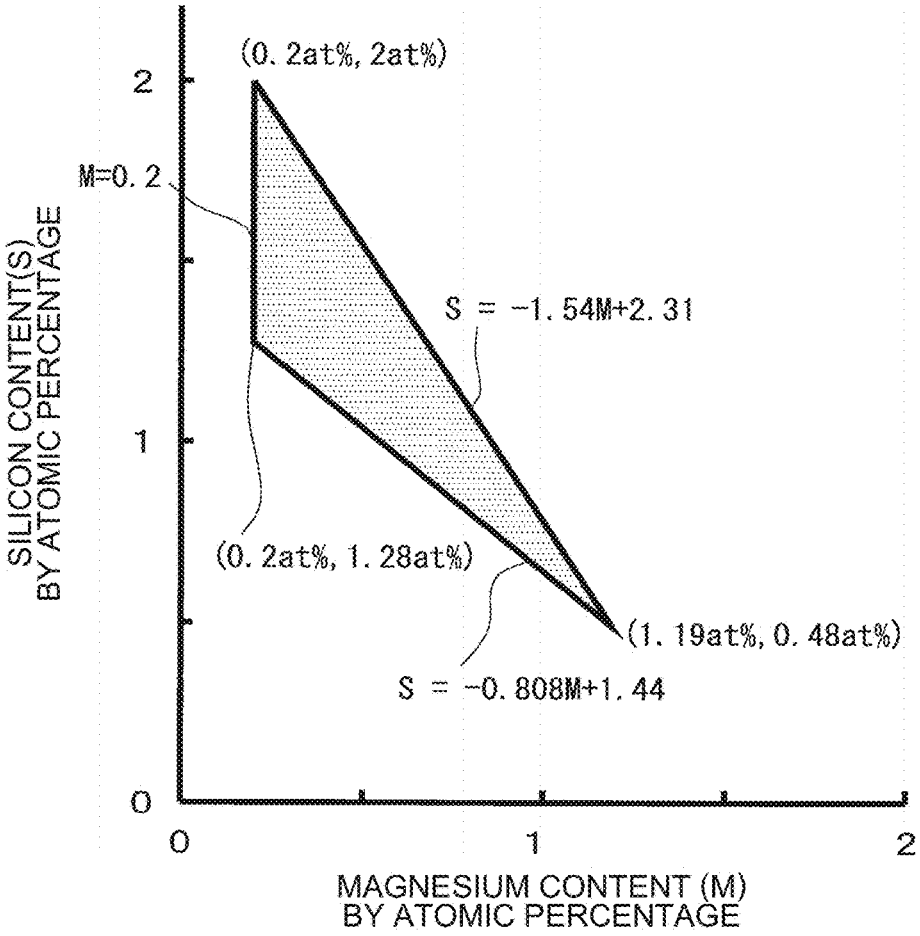
FIG. 1 is a graph illustrating respective ranges represented by the expressions (1) and (2).

In the aluminum alloy wire of the present invention, the composition thereof needs to include magnesium, silicon, and aluminum and inevitable impurities as the balance, the content (M) by atomic percentage (at %) of the magnesium and the content (S) by atomic percentage (at %) of the silicon satisfying the following expressions (1) and (2). In FIG. 1, its vertical axis represents the content (M) by atomic percentage (at %) of magnesium, and its transverse axis represents the content (S) by atomic percentage (at %) of silicon (Si). In this case, a scope represented as a hatched triangle (the scope including a boundary between the scope and the outside) is a scope in which the expressions (1) and (2) are satisfied.

[Mathematical Formula 2]

$$0.2 \leq M \leq 1.19 \quad (1), \text{ and}$$

$$-0.81M+1.44 \leq S \leq -1.54M+2.31 \quad (2)$$

If the proportion of magnesium is too small, the strength of the alloy is less than 150 MPa. If the proportion is too large, the elongation thereof is less than 10%.

If the proportion of silicon is too small relatively to that of magnesium, the strength is less than 150 MPa. If the proportion of silicon is too large relatively thereto, the elongation is less than 10%.

A constituent component of the aluminum alloy wire of the present invention is aluminum besides magnesium and silicon. However, the aluminum alloy wire may include inevitable impurities. Examples of the inevitable impurities include zinc (Zn), nickel (Ni), manganese (Mn), rubidium (Rb), chromium (Cr), titanium (Ti), tin (Sn), vanadium (V), gallium (Ga), boron (B), and sodium (Na). The proportion of these impurities is preferably 0.07% or less by mass since the advantageous effects of the present invention are not damaged.

A metallic microstructure of a cross section of the aluminum alloy wire of the present invention needs to have an average crystal grain size of 3 μm or more to 20 μm or less.

If the metallic microstructure is too small in average crystal grain size, the elongation is less than 10%. Moreover, even when the average crystal grain size is too large relatively to the size of an element wire of the alloy wire, the elongation is less than 10%.

It is also essential that the metallic microstructure of the cross section of the aluminum alloy wire of the present invention includes precipitations, and the precipitation size thereof is 100 nm or less.

In the metallic microstructure, precipitations made of, for example, $Mg_2Si$, or Si are generated. If the precipitation size of the precipitations is too large, the strength is less than 150 MPa.

Furthermore, it is essential that in the cross section, the number density of the precipitations is one or more per square micrometer. If the number density of the precipitations is too small, the strength is less than 150 MPa.

Such an aluminum alloy wire can be yielded as follows:

As raw materials, the following are used: a class-1 aluminum base metal prescribed in JIS H 2102, pure Mg or Al—Mg alloy; and Al—Si alloy. These are formulated into a predetermined blend ratio. The blend is melted in a container such as a crucible, and then poured into a mold to yield a cast ingot. This cast ingot is worked into a predetermined size, using a rolling machine and wire drawing. The metallic material is heated into, for example, about 520° C. or higher to be subjected to solution treatment, and then cooled by the air. Next, a wire drawing machine is used to subject the metallic material to wire drawing into a sectional-area reduction of 99% or more until the material has a predetermined final wire diameter (such as 0.5 sq, 0.35 sq, 0.22 sq or 0.13 sq). The resultant wire is wound up as required. The step for the rolling, and the steps previous thereto may be performed, using a continuous casting and rolling machine.

Next, the wire is subjected to aging treatment. In connection with conditions for the treatment, the treatment is conducted at a temperature of 200° C. or more to 250° C. or less for a period of 0.5 hour or more to 1 hour or less.

If the temperature for the aging treatment is too low, the elongation of the resultant may become less than 10%. If the temperature is too high, the strength thereof may become less than 150 MPa. The temperature ranges in particular preferably from 230° C. or more to 240° C. or less.

If the treatment period for the aging treatment is too short, the elongation may become less than 10%. If the period is too long, the strength may become less than 150 MPa. The period ranges in particular preferably from 0.5 to 0.75 hour or less.

Figure 2:
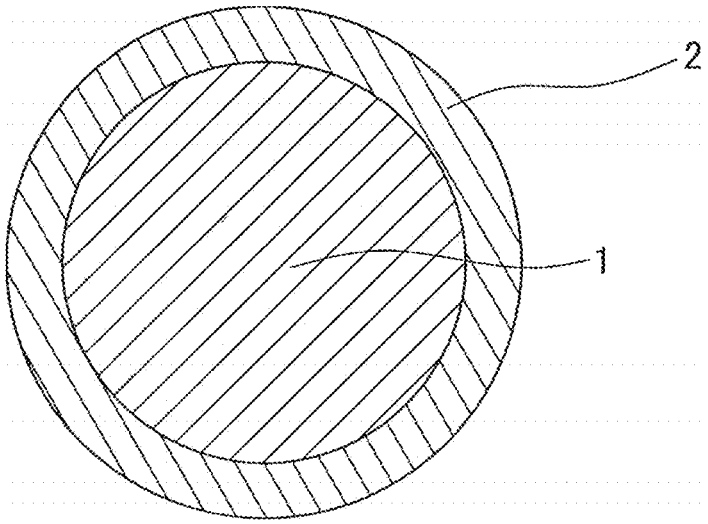
FIG. 2 is a sectional view of a model of an electric wire (coated electric wire) according to the present invention.

After the aging treatment is conducted, in the same way as used for ordinary core wires, the resultant wire is optionally combined with the same wire, and the wire or the combined wires are twisted or compressed to yield a conductor. Thereafter, the conductor is converted into a coated electric wire, using extrusion molding (FIG. 2 illustrates a sectional view of a model of a coated electric wire in which the aluminum metal wire according to the present invention is used as a core wire 1. In FIG. 2, reference number 2 represents a coat layer). Alternatively, the resultant conductor and the same conductors are bundled into a single wire, and the wire is subjected to outer packaging to produce a cable or wire harness. The aging treatment may be conducted after the twisting and compressing are performed.

The thus obtained electric wire has a sufficient strength, a sufficient elongation and a sufficient electroconductivity to be usable suitably for a small-diameter aluminum electric wire for an automobile.

The above has described the present invention by way of the preferred embodiment. However, the aluminum alloy wire, the electric wire, the cable and the wire harness of the present invention are not limited to the respective structures of those of the embodiment.

Those skilled in the art can appropriately modify the aluminum alloy wire, the electric wire, the cable and the wire harness of the present invention in accordance with findings known in the prior art. As far as the modified products have the aluminum alloy wire, the electric wire, the cable and the wire harness of the present invention, respectively, in spite of the modification, the products are, of course, included in the scope of the present invention.

Examples

Hereinafter, the aluminum metal wire of the present invention will be more specifically described by demonstrating working examples thereof.

<Casting Step>

Magnesium and silicon were blended with aluminum to have a blend ratio for each of Examples 1 to 9 and Comparative Examples 1 to 4 shown in Table 1, and the blend was melted in a crucible and then poured into a mold. In this way, each cast ingot was yielded.

<Rolling/Wire Drawing Steps>

A rolling machine and a wire drawing machine were used to work each of the cast ingots into predetermined sizes to yield two rolled material species, one of which had a wire diameter of 18 mm (for rolling into a sectional-area reduction of 99.9%, which will be described later), and the other of which had a wire diameter of 3.2 mm (for rolling into a sectional-area reduction of 99%, which will be described later). This step, and the step previous thereto may be performed, using a continuous casting and rolling machine, and a wire drawing machine.

<Solution Treatment Step>

Each of the rolled and wire-drawn materials was subjected to solution treatment at 520° C. for 30 minutes to yield a solution-treated material. At this time, inevitable impurities therein were analyzed, using an ICP emission spectrometer. As a result, the solution-treated material includes zinc (Zn), nickel (Ni), manganese (Mn), rubidium (Rb), chromium (Cr), titanium (Ti), tin (Sn), vanadium (V), gallium (Ga), boron (B) and sodium (Na). The proportion of each of these elements was 0.07% or less by mass in each of the materials in each of the examples.

<Wire Drawing Step>

One of the two solution-treated materials in each of the examples was cooled with the air, and then wire-drawn into a section-area reduction shown in Table 1, using a wire drawing machine. The resultant was wound up onto a bobbin. The final wire diameter of the resultant metal wire was 322 μm.

<Aging Treatment>

In the state that each of the metal wires yielded by the wire drawing was wound up, the metal wire was subjected to aging treatment in conditions shown in Table 1. Thereafter, the resultant wire was cooled with the air. In this way, 13 aging-treated aluminum metal wire species was yielded.

<Evaluation>

A cross section polisher was used to cut each of the 13 aging-treated aluminum metal wire species, and a cross section of the wire species was observed through a scanning electron microscope (SEM). The wire species was then examined about the average crystal grain size, the average precipitation size, and the average precipitation number density thereof.

Specifically, about the average crystal grain size, the wire species was measured about the crystal orientation thereof in a 150 μm×50 μm area extended from the center of the cross section of this element wire toward the outer circumstance of the wire by electron back scatter diffraction patterns (EBSD). From the results thereof, any moiety having a crystal orientation difference of 2 degrees or more was regarded as a crystal grain boundary, and the size of identified crystal grains was obtained as the weighted average according to the ratio by area therebetween.

About the average precipitation size, $Mg_2Si$ precipitations and Si precipitations were identified according to element mapping of Al, Mg and Si according to a TEM/EDX analysis of the wire species, and the size of 50 precipitations selected at random therefrom was obtained as the arithmetic average thereof.

About the average precipitation number density, $Mg_2Si$ precipitations and Si precipitations were identified according to element mapping of Al, Mg and Si according to a TEM/EDX analysis of the wire species, and the number of the identified precipitations was measured. The number density was obtained by dividing the measured number by the (measured) area.

In accordance with JIS Z2241, about each of the 13 solution-treated aluminum metal wire species, the tensile strength and the elongation thereof were measured. Moreover, in accordance with JIS H0505, the electroconductivity was measured.

These evaluation results are together shown in Table 1.

Figure 3:
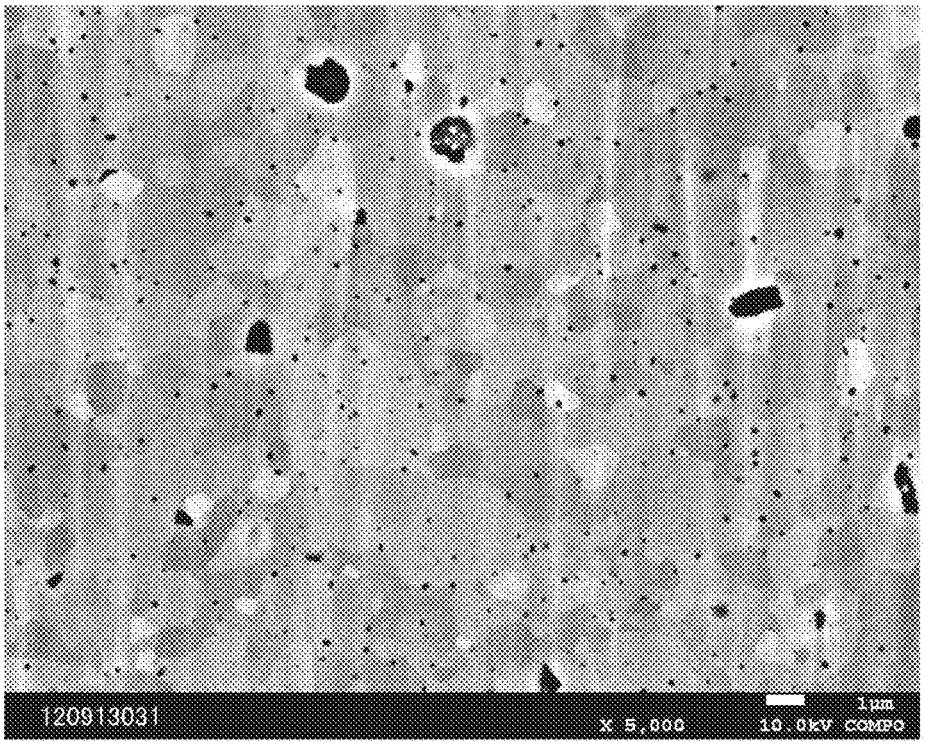
FIG. 3 shows a working example of the present invention.

Furthermore, FIG. 3 shows a photograph of a cross section of the aluminum metal wire according to Example 9 through the scanning electron microscope.

TABLE 1

| | NO. | Mg AT % | Si AT % | SOLUTION TREATMENT TEMPERATURE ° C. | SOLUTION TREATMENT PERIOD hr | WIREDRAWING SECTIONAL-AREA REDUCTION % | AGING TREATMENT TEMPERATURE ° C. | AGING TREATMENT PERIOD hr | AVERAGE CRYSTAL GRAIN SIZE μm |
|---|---|---|---|---|---|---|---|---|---|
| EXAMPLES | 1 | 1.19 | 0.48 | 520 | 0.5 | 99.9 | 225 | 0.5 | 5 |
| | 2 | 0.20 | 2.00 | 520 | 0.5 | 99.9 | 225 | 0.5 | 5 |
| | 3 | 0.20 | 2.00 | 520 | 0.5 | 99.9 | 250 | 1.0 | 10 |
| | 4 | 0.20 | 2.00 | 520 | 0.5 | 99.0 | 250 | 1.0 | 10 |
| | 5 | 0.20 | 1.28 | 520 | 0.5 | 99.9 | 200 | 0.5 | 3 |
| | 6 | 0.20 | 1.28 | 520 | 0.5 | 99.9 | 225 | 0.5 | 5 |
| | 7 | 0.20 | 1.28 | 520 | 0.5 | 99.0 | 200 | 0.5 | 3 |
| | 8 | 0.20 | 1.28 | 520 | 0.5 | 99.0 | 225 | 0.5 | 5 |
| | 9 | 0.80 | 1.00 | 520 | 0.5 | 99.9 | 225 | 0.5 | 5 |
| COMPARATIVE EXAMPLES | 1 | 0.8 | 0.4 | 520 | 0.5 | 99.9 | 225 | 0.5 | 10 |
| | 2 | 1.2 | 0.6 | 520 | 0.5 | 99.9 | 225 | 0.5 | 4 |
| | 3 | 0.80 | 1.00 | 520 | 0.5 | 99.9 | 225 | 1.5 | 5 |
| | 4 | 0.80 | 1.00 | 520 | 0.5 | 99.9 | 275 | 0.5 | 15 |

| | NO. | AVERAGE PRECIPITATION SIZE nm | AVERAGE PRECIPITATION NUMBER DENSITY THE NUMBER OF PRECIPITATION/μm$^2$ | TENSILE STRENGTH MPa | ELONGATION % | ELECTRO-CONDUCTIVITY % IACS |
|---|---|---|---|---|---|---|
| EXAMPLES | 1 | 90 | 1.2 | 150 | 10 | 61.6 |
| | 2 | 90 | 1.2 | 204 | 10 | 60.4 |
| | 3 | 100 | 1.0 | 184 | 14 | 60.7 |
| | 4 | 100 | 1.0 | 184 | 13 | 60.7 |
| | 5 | 80 | 1.5 | 170 | 17 | 61.8 |
| | 6 | 90 | 1.2 | 150 | 21 | 62.1 |
| | 7 | 80 | 1.5 | 170 | 15 | 61.8 |
| | 8 | 90 | 1.2 | 150 | 19 | 62.1 |
| | 9 | 90 | 1.2 | 166 | 11 | 61.3 |
| COMPARATIVE EXAMPLES | 1 | 90 | 0.8 | 120 | 20 | 62.7 |
| | 2 | 90 | 1.2 | 160 | 8 | 61.3 |
| | 3 | 95 | 1.1 | 137 | 10 | 61.7 |
| | 4 | 100 | 1.0 | 126 | 19 | 61.9 |

From Table 1, it is understood that the aluminum metal wire according to the present invention satisfies all of standard values expected for a small-diameter aluminum electric wire, which are expected that the tensile strength is 150 MPa or more, the elongation is 10% or more and the electroconductivity is 50% IACS.

REFERENCE SIGNS LIST

1: Core wire
2: Coat layer

The invention claimed is:

1. An aluminum alloy wire comprising:

(A) a metallic microstructure of a cross section of the wire having an average crystal grain size of 3 μm or more to 20 μm or less, (B) the metallic microstructure includes precipitations, and each precipitation has a precipitation size in a cross section of the aluminum alloy wire of 100 nm or less, and (C) the number density of the precipitations in the cross section of the aluminum alloy wire being one or more per square micrometer, wherein a constituent component of the aluminum alloy wire is magnesium, silicon, and aluminum and inevitable impurities as the balance such that a proportion of the impurities is 0.07% or less by mass and a resulting proportion of the constituent component of magnesium, silicon, and aluminum is 99.93% or more by mass, and wherein the content (M) by atomic percentage (at %) of the magnesium in the wire and the content (S) by atomic percentage (at %) of the silicon satisfy the following expressions (1) and (2):

[Mathematical Formula 1]

$$0.2 \leq M \leq 1.19 \quad (1); \text{ and}$$

$$-0.81M+1.44 \leq S \leq -1.54M+2.31 \quad (2), \text{ and}$$

wherein the aluminum alloy has a tensile strength of 150 MPa or more, a tensile elongation of 10% or more, and an electroconductivity of 50% IACS or more.

2. The aluminum alloy wire according to claim 1, obtained by subjecting a raw material to solution treatment, subjecting the treated material to wire drawing into a sectional-area reduction of 99% or more until the material has a final wire diameter, and subsequently subjecting the resultant wire to aging treatment at a temperature of 200 to 250° C. or less for a period of 0.5 to 1 hour or less.

3. An electric wire, comprising, as a conductor, the aluminum alloy wire according to claim 1.

4. An electric wire, comprising, as a conductor, the aluminum alloy wire according to claim 2.

5. A cable, comprising, as a conductor, the aluminum alloy wire according to claim 1.

6. A cable, comprising, as a conductor, the aluminum alloy wire according to claim 2.

7. A wire harness for an automobile, comprising the electric wire according to claim 3.

8. A wire harness for an automobile, comprising the electric wire according to claim 4.

* * * * *